US009909392B2

(12) United States Patent
Themig

(10) Patent No.: US 9,909,392 B2
(45) Date of Patent: Mar. 6, 2018

(54) WELLBORE FRAC TOOL WITH INFLOW CONTROL

(71) Applicant: PACKERS PLUS ENERGY SERVICES INC., Calgary (CA)

(72) Inventor: Daniel Jon Themig, Calgary (CA)

( * ) Notice: Subject to any disclaimer, the term of this patent is extended or adjusted under 35 U.S.C. 154(b) by 45 days.

(21) Appl. No.: 14/918,049

(22) Filed: Oct. 20, 2015

(65) Prior Publication Data

US 2016/0298424 A1 Oct. 13, 2016

Related U.S. Application Data

(63) Continuation of application No. 13/820,850, filed as application No. PCT/CA2011/001027 on Sep. 12, 2011, now Pat. No. 9,187,994.

(Continued)

(51) Int. Cl.
*E21B 43/26* (2006.01)
*E21B 34/14* (2006.01)

(Continued)

(52) U.S. Cl.
CPC ..... *E21B 34/14* (2013.01); *E21B 34/103* (2013.01); *E21B 34/12* (2013.01); *E21B 43/08* (2013.01);

(Continued)

(58) Field of Classification Search
CPC ..... E21B 34/12; E21B 34/10; E21B 34/14; E21B 43/16; E21B 43/262

(Continued)

(56) References Cited

U.S. PATENT DOCUMENTS 2,903,074 A 9/1959 Layton et al.
2,922,479 A 1/1960 Kinley (Continued)

FOREIGN PATENT DOCUMENTS

CA 2625662 A1 11/2008
CN 101812981 8/2010

(Continued)

OTHER PUBLICATIONS

International Search Report and Written Opinion for International Patent Application No. PCT/CA2011/001027, dated Nov. 29, 2011, 8 pgs.

(Continued)

*Primary Examiner* — Kenneth L Thompson

(57) ABSTRACT

An apparatus for fluid treatment of a borehole, the apparatus allowing initial outflow injection of fluids into a wellbore in which it is installed and then is actuable to allow fluid inflow control. The apparatus includes: a tubular body, a first port and a second port opened through the wall of the tubular body, the second port having a fluid inflow controller positioned to control the flow of fluid into the tubular body through the port, a sliding sleeve valve in the tubular body moveable from (i) a first position closing the first port and the second port to (ii) a second position closing the second port and permitting fluid flow through the first port and to (iii) a third position closing the first port and permitting fluid flow through the second port; a sleeve actuator for actuating the sliding sleeve valve to move from the first position to the second position in response to a force applied thereto; a releasable lock for locking the sliding sleeve valve in the first position and selected to maintain the sliding sleeve valve in the first position after the force is removed; and a lock release mechanism configured to actuate the releasable (Continued)

lock to release the sliding sleeve valve to move into the third position.

15 Claims, 8 Drawing Sheets

Related U.S. Application Data

(60) Provisional application No. 61/385,284, filed on Sep. 22, 2010.

(51) Int. Cl.

| | |
|---|---|
| ***E21B 34/10*** | (2006.01) |
| ***E21B 34/12*** | (2006.01) |
| ***E21B 43/08*** | (2006.01) |
| ***E21B 43/12*** | (2006.01) |
| *E21B 34/00* | (2006.01) |
| *E21B 33/12* | (2006.01) |
| *E21B 37/06* | (2006.01) |
| *E21B 43/16* | (2006.01) |
| *E21B 43/267* | (2006.01) |

(52) U.S. Cl.
CPC ..... *E21B 43/12* (2013.01); *E21B 43/26* (2013.01); *E21B 33/12* (2013.01); *E21B 37/06* (2013.01); *E21B 43/164* (2013.01); *E21B 43/267* (2013.01); *E21B 2034/007* (2013.01)

(58) Field of Classification Search
USPC ..... 166/177.5, 308.1, 374, 319, 321, 332.1, 166/334.4
See application file for complete search history.

(56) References Cited

U.S. PATENT DOCUMENTS

| | | | |
|---|---|---|---|
| 3,095,040 | A | 6/1963 | Bramlett |
| 4,105,069 | A | 8/1978 | Baker |
| 4,577,702 | A | 3/1986 | Faulkner |
| 4,603,741 | A | 8/1986 | Edgmon |
| 4,693,314 | A | 9/1987 | Wesson et al. |
| 4,846,272 | A | 7/1989 | Leggett |
| 4,917,191 | A | 4/1990 | Hopmann et al. |
| 5,012,871 | A | 5/1991 | Pleasants et al. |
| 5,137,087 | A | 8/1992 | Szarka et al. |
| 5,263,683 | A | 11/1993 | Wong |
| 5,413,180 | A | 5/1995 | Ross et al. |
| 5,526,881 | A | 6/1996 | Martin et al. |
| 5,957,207 | A | 9/1999 | Schnatzmeyer |
| 6,003,607 | A | 12/1999 | Hagen et al. |
| 6,253,861 | B1 | 7/2001 | Carmichael et al. |
| 6,397,950 | B1 | 6/2002 | Streich et al. |
| 6,763,892 | B2 | 7/2004 | Kaszuba |
| 6,997,263 | B2 | 2/2006 | Campbell et al. |
| 7,108,067 | B2 | 9/2006 | Themig et al. |
| 7,387,165 | B2 | 6/2008 | Lopez de Cardenas et al. |
| 7,431,091 | B2 | 10/2008 | Themig et al. |
| 7,533,727 | B2 | 5/2009 | Barton et al. |
| 7,543,634 | B2 | 6/2009 | Fehr et al. |
| 7,703,510 | B2 | 4/2010 | Xu |
| 7,730,949 | B2 | 6/2010 | Guignard et al. |
| 7,748,460 | B2 | 7/2010 | Themig et al. |
| 8,307,902 | B2 | 11/2012 | Telfer |
| 9,187,994 | B2 * | 11/2015 | Themig ..... E21B 34/103 |
| 2003/0127227 | A1 | 7/2003 | Fehr et al. |
| 2006/0124310 | A1 | 6/2006 | Lopez et al. |
| 2007/0039741 | A1 | 2/2007 | Hailey |
| 2007/0144731 | A1 | 6/2007 | Murray |
| 2007/0272411 | A1 | 11/2007 | Lopez de Cardenas et al. |
| 2009/0044944 | A1 | 2/2009 | Murray et al. |
| 2009/0056934 | A1 | 3/2009 | Xu |
| 2009/0056952 | A1 | 3/2009 | Churchill |
| 2009/0065194 | A1 | 3/2009 | Frazier |
| 2009/0065199 | A1 | 3/2009 | Patel et al. |
| 2009/0084553 | A1 | 4/2009 | Rytlewski et al. |
| 2009/0139717 | A1 | 6/2009 | Richard et al. |
| 2010/0000727 | A1 | 1/2010 | Webb et al. |
| 2010/0200243 | A1 | 8/2010 | Purkis |
| 2010/0282469 | A1 | 11/2010 | Richard et al. |
| 2011/0005759 | A1 | 1/2011 | Xu |
| 2011/0056288 | A1 | 3/2011 | Smithson |
| 2011/0192613 | A1 | 8/2011 | Garcia et al. |
| 2011/0232915 | A1 | 9/2011 | Kellner et al. |
| 2011/0253383 | A1 | 10/2011 | Porter |
| 2011/0303420 | A1 | 12/2011 | Thorkildsen |
| 2012/0012322 | A1 | 1/2012 | Korkmaz |
| 2012/0048559 | A1 | 3/2012 | Ganguly |
| 2012/0103628 | A1 | 5/2012 | Stout |
| 2012/0305243 | A1 | 12/2012 | Hallundb æk et al. |
| 2014/0224471 | A1 | 8/2014 | Coon |
| 2015/0034324 | A1 | 2/2015 | Norrid |

FOREIGN PATENT DOCUMENTS

| | | | |
|---|---|---|---|
| EP | 0985799 | A2 | 3/2000 |
| EP | 1473434 | A1 | 11/2004 |
| GB | 2193741 | A | 2/1988 |
| WO | WO 2009/029437 | A1 | 3/2009 |
| WO | WO 2009/132462 | | 5/2009 |
| WO | WO 2011/079391 | A1 | 7/2011 |
| WO | WO 2011/097632 | A1 | 8/2011 |

OTHER PUBLICATIONS

International Search Report and Written Opinion for International Patent Application No. PCT/CA2012/050612, dated Nov. 26, 2012, 7 pgs.

International Preliminary Report on Patentability (Ch. I) and Written Opinion for International Patent Application No. PCT/CA2011/001027, dated Mar. 26, 2013, 6 pgs.

International Preliminary Report on Patentability (Ch. I) and Written Opinion for International Patent Application No. PCT/CA2012/050612, dated Mar. 12, 2014, 5 pgs.

Supplemental European Search Report for European Patent Application No. 12831984.5, dated Jul. 9, 2015, 5 pgs.

Office Action for U.S. Appl. No. 14/343,357, dated Apr. 20, 2016, 12 pgs.

Office Action for U.S. Appl. No. 14/343,357, dated Sep. 29, 2016, 17 pgs.

* cited by examiner

WELLBORE FRAC TOOL WITH INFLOW CONTROL

FIELD

The invention relates to a method and apparatus for wellbore fluid treatment and, in particular, to a method and apparatus for selective communication to a wellbore for fluid treatment and effectively handling produced fluids.

BACKGROUND

An oil or gas well relies on inflow of petroleum products. When natural inflow from the well is not economical, the well may require wellbore treatment termed stimulation. This is accomplished by pumping stimulation fluids such as fracturing fluids, acid, cleaning chemicals and/or proppant laden fluids to improve wellbore inflow.

In one previous method, the well is isolated in segments and one or more segments are individually treated so that concentrated and controlled fluid treatment can be provided along the wellbore by injecting the wellbore stimulation fluids from a tubing string through a port in the segment and into contact with the formation. After wellbore fluid treatment, the stimulation fluids are sometimes allowed to back flow from the formation into the wellbore tubing string. Thereafter, fluids are produced from the formation. In some embodiments, the produced fluids also enter the tubing string for flow to the surface. Such wellbore treatment systems are described in U.S. Pat. Nos. 7,748,460 and 7,543,634 and PCT application PCT/CA2009/000599.

It may be advantageous in certain circumstances to control the inflow of produced fluids. For example, it may be advantageous to screen the produced fluids before they enter the tubing string. In addition or alternately, the produced fluids may require flow rate control, as by use of chokes including devices called inflow control devices (ICD).

Where a wellbore frac tool also provides for inflow control, it is useful if fracing fluids not be forced out through the same ports that offer inflow control.

SUMMARY

In accordance with a broad aspect of the present invention, there is provided an apparatus for fluid treatment of a borehole, the apparatus comprising: a tubular body having a long axis and an upper end, a first port opened through the wall of the tubular body, a second port opened through the wall of the tubular body, the second port axially offset from the first port and having a fluid inflow controller positioned to control the flow of fluid into the tubular body through the port; a sliding sleeve valve in the tubular body moveable from (i) a first position closing the first port and the second port to (ii) a second position closing the second port and permitting fluid flow through the first port and to (iii) a third position closing the first port and permitting fluid flow through the second port; a sleeve actuator for actuating the sliding sleeve valve to move from the first position to the second position in response to a force applied thereto; a releasable lock for locking the sliding sleeve valve in the first position and selected to maintain the sliding sleeve valve in the first position after the force is removed; and a lock release mechanism configured to actuate the releasable lock to release the sliding sleeve valve to move into the third position.

There is also provided a method for fluid treatment of a borehole, the method comprising: running a tubing string into a wellbore to a desired position for treating the wellbore; opening a frac port by application of a force to a sliding sleeve valve for the port; injecting stimulating fluids through the frac port; releasably locking the sliding sleeve valve in an open position to allow flowback of the stimulating fluid; unlocking the sliding sleeve valve to close the port and open a fluid control port; and permitting fluid to pass from the wellbore into the tool through the fluid control port.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

Figure 1A:
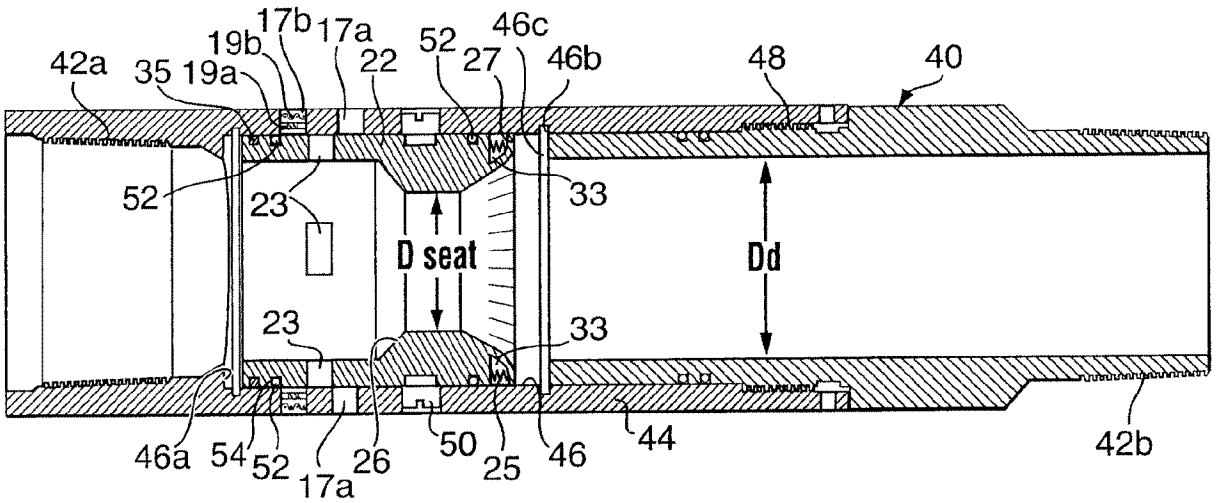
FIG. 1*a* is a sectional view along the long axis of a frac tool in the form of a tubing string sub containing a sleeve in a closed port position.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts. It is noted, for example, that the running tool of FIG. 1 differs from that of FIGS. 2 and 3 in some ways although some identical numbering is used in the two sets of figures.

A method and apparatus has been invented which provides for injecting of a wellbore treatment fluid and then reconfiguration to control the flow of produced fluids. The apparatus and methods of the present invention can be used in various borehole conditions including open holes, cased holes, vertical holes, horizontal holes, straight holes or deviated holes.

In one embodiment, there is provided an apparatus for fluid treatment of a borehole, the apparatus comprising: a tubular body having a long axis and an upper end, a first port opened through the wall of the tubular body, a second port opened through the wall of the tubular body, the second port axially offset from the first port and having a fluid inflow controller positioned to control the flow of fluid into the tubular body through the port; a sliding sleeve valve in the tubular body moveable from (i) a first position closing the first port and the second port to (ii) a second position closing the second port and permitting fluid flow through the first port and to (iii) a third position closing the first port and permitting fluid flow through the second port; a sleeve actuator for actuating the sliding sleeve valve to move from the first position to the second position in response to a force applied thereto; a releasable lock for locking the sliding sleeve valve in the first position and selected to maintain the sliding sleeve valve in the first position after the force is removed; and a lock release mechanism configured to actuate the releasable lock to release the sliding sleeve valve to move into the third position.

The fluid inflow controller may be selected to control any of various features of the fluid. For example, the fluid inflow controller may include one or more of a screen for filtering out oversize solids from the fluid or a choke for controlling the pressure drop and/or flow rate of the fluid passing through the second port. One type of choke is commonly known as an inflow control device (ICD). ICDs use various mechanisms to control flow rate and pressure drop such as labyrinths, surface roughening, passage arrangements, nozzles, gates, etc.

In one embodiment, the sleeve actuator is a manipulation string that is run in to engage the sleeve and move it to the second position. In yet another embodiment, the sleeve actuator is a motor drive. Of course, other actuators are possible. Preferably, however, the sleeve is actuated remotely, without the need to trip a work string such as a tubing string or a wire line. In another embodiment, therefore, the sleeve actuator includes a seat formed on the sliding sleeve valve and a plug sized to land in and seal against the seat, such that a pressure can be built up such that fluid pressure force is applied to move the sleeve. In yet another embodiment, the sleeve may be of the pressure chamber type, as described in the above-noted PCT application.

The releasable lock may take various forms provided it is actuable to lock the sleeve in the second position and maintain it there even when the force that originally drove the sleeve to the second position is removed. The releasable lock may include, for example, one or more catches such as one or more of a collet, a locking dog, a snap ring, spring loaded detents, a section of enlarged diameter, etc. and a corresponding site such as a groove, hole, protrusion onto which the lock may engage.

The lock release mechanism may take various forms as well. Its form may depend on the form of the releasable lock. In one embodiment, the lock release mechanism is a manipulation string that is run in to engage the sleeve and move it from the second position to the third position. In another embodiment, the lock release mechanism is a lock removal feature of the releasable lock environment that is actuated by a drilling tool run to remove the ball seats and clean out the ID of the tubular.

In one embodiment, the tubular body includes ends formed for connection into a tubing string, such as a production string, casing, work string, etc. As such the tool can be incorporated into a tubing string for placement in a wellbore. The string may include other components such as further frac tools, packers, centralizers, etc. The packers can be of any desired type to seal between the wellbore and the tubing string. In one embodiment, at least one of the first, second and third packer is a solid body packer including multiple packing elements. In such a packer, it is desirable that the multiple packing elements are spaced apart.

In view of the foregoing there is provided a method for fluid treatment of a borehole, the method comprising: providing an apparatus for wellbore treatment according to one of the various embodiments of the invention; running the tubing string into a wellbore in a desired position for treating the wellbore; opening a frac tool port by application of a force to a sliding sleeve valve for the port; injecting stimulating fluids through the port; releasably locking the sliding sleeve valve in an open position to allow flowback of the stimulating fluid; unlocking the sliding sleeve valve to close the port and open a fluid control port; and permitting fluid to pass from the wellbore into the tool through the fluid control port.

In one method according to the present invention, the fluid treatment is borehole stimulation using stimulation fluids such as one or more of acid, gelled acid, gelled water, gelled oil, $CO_2$, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation.

In an open hole, the packers may include solid body packers including a solid, extrudable packing element and, in some embodiments, solid body packers include a plurality of extrudable packing elements. The first packer and the second packer can be formed as a solid body packer including multiple packing elements, for example, in spaced apart relation.

Figure 1B:
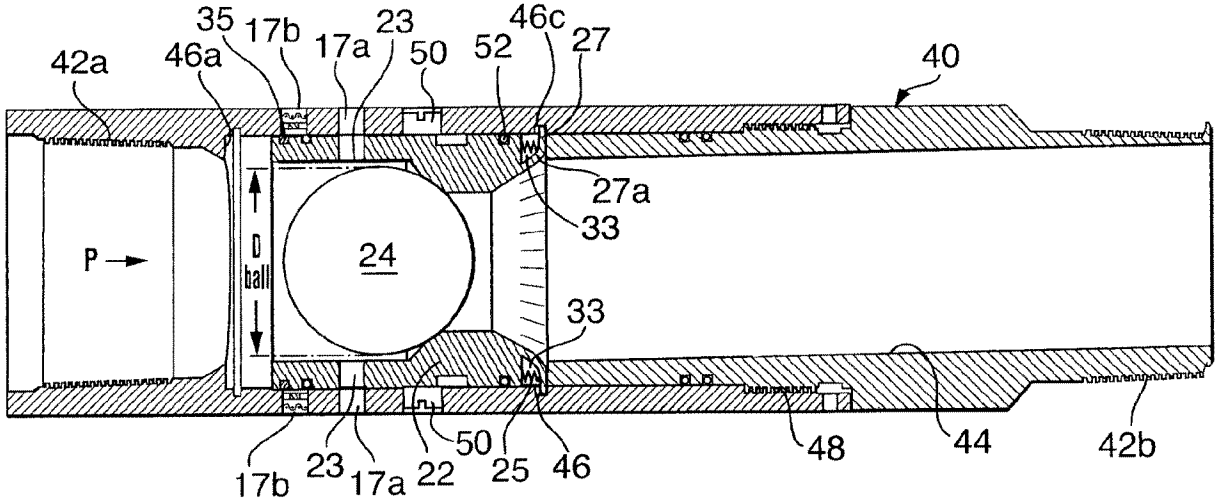
FIG. 1*b* is a sectional view along the sub of FIG. 1*a* with the sleeve in a position allowing fluid flow through fluid treatment ports.
Figure 1C:
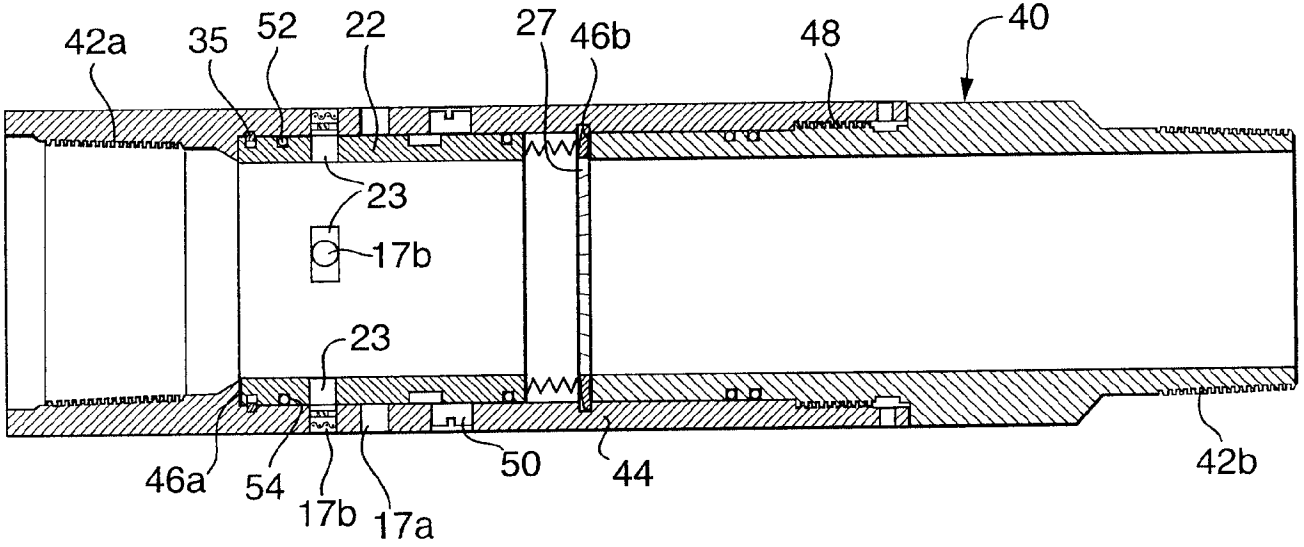
FIG. 1*c* is a sectional view along the sub of FIG. 1*a* with the sleeve in a position allowing fluid flow through fluid control ports.

Referring to FIGS. 1*a*, 1*b* and 1*c*, a frac tool with inflow control is shown. The tool is in the form of a tubing string sub having a tubular body 40, one or more first ports 17*a*, one or more second ports 17*b* axially offset from the first ports and a sleeve 22.

First set of ports 17*a* are suitable for injecting stimulating fluid therethrough from the body's inner bore to its outer surface. As such ports 17*a* may be generally free of inserts that reduce the effectiveness of stimulating fluid being injected outwardly therethrough. For example, where the ports are intended for fracturing treatment of the formation, they may be free of any inserts or may contain outflow force increasing nozzles etc. that increase the fracturing effect of the fluid as it passes out from the tubular. Ports intended for fracturing treatment therethrough are generally free of screens, inflow restricting chokes, etc., as these devices generally reduce the force of or interfere with outflows.

Second set of ports 17*b* are configured to control fluid passing inwardly therethrough and may contain inserts that effect a control on the fluid. For example, an inflow control device 19*a* that is configured to effect the flow rate and/or pressure drop of fluid passing therethrough and/or a screen 19*b* to filter oversize particles, both of which are shown in this embodiment. Although ports 17*b* are shown axially below ports 17*a*, this is not necessary. The axial placement of the ports could be reversed provided the sleeve is configured and installed to move in such a way that permits ports 17*a* and ports 17*b* to be opened each in turn.

The sleeve is axially slideable along internally or externally of the tubular body and is moveable through a plurality of positions to regulate fluid flow into and out of the tubular body. In a first position (FIG. 1*a*), sleeve 22 is positioned over first ports 17*a* and second ports 17*b* to close all of them against fluid flow therethrough. In a second position, as shown in FIG. 1*b*, the sleeve is moved such that ports 17*a* are open and fluid can flow therethrough, while ports 17*b* remain closed. In a third position (FIG. 1*c*), sleeve 22 is moved to close fluid flow through ports 17*a*, while ports 17*b* are open to fluid flow therethrough. As such, in the first position the tubular is suitable for at least run in procedures, in the second position, the frac tool is suitable for injecting stimulating fluid through ports 17*a* into the surrounding wellbore and in the third position, the tool is suitable for accepting flow back of production fluids, controlling their flow as they enter the tubular body.

Sleeve 22 is moveable between the three positions.

The sub 40 includes threaded ends 42*a*, 42*b* for connection into a tubing string. Sub includes a wall 44 having formed on its inner surface a cylindrical groove 46 for retaining sleeve 22. Shoulders 46*a*, 46*b* define the ends of the groove 46 and shoulder 46*a* and an annular recess 46*c* creates a stop for limiting the range of movement of the sleeve within the groove. Shoulders 46*a*, 46*b* and recess 46*c* can be formed in any way as by casting, milling, etc. the wall material of the sub or by threading parts together, as at connection 48. The tubing string if preferably formed to hold pressure. Therefore, any connection should, in the preferred embodiment, be selected to be substantially pressure tight.

In this illustrated embodiment, sleeve 22 has one or more sleeve ports 23. As illustrated, in this embodiment, when in the first position, sleeve 22 is positioned with sleeve ports 23 positioned radially over a solid portion of tubular body wall 44 and are neither aligned with ports 17*a* nor ports 17*b*. As such, a solid portion of sleeve 22 is positioned over, blocking flow through, ports 17*a*, 17*b*. When in the second and third positions, the sleeve is moved such that sleeve ports 23 align with ports 17*a* and ports 17*b*, respectively.

Shear pins 50 are secured between wall 44 and sleeve 22 to hold the sleeve in the first position.

An actuator is provided for moving sleeve 22 from the first position to the second position. The actuator may be any device or method, numerous of which are known. In this illustrated embodiment, the actuator includes a plug and a seat formed on the sleeve. A plug in the form of a ball 24 is used to land in seat 26 and with fluid pressure apply a force to shear pins 50 and to move the sleeve from the first position to the second position. In particular, the inner facing surface of sleeve 22 defines a seat 26 having a diameter Dseat, and ball 24, is sized, having a diameter Dball, to pass through the drift diameter Dd of the tubular body but engage and seal against seat 26. When pressure is applied, as shown by arrows P, against ball 24, shears 50 will release allowing sleeve 22 to be driven toward shoulder 46*b* until collet fingers 27 land in recess 46*c* and the sleeve is stopped. The length of the sleeve and location of the ports 23 are selected with consideration as to the distance between recess 46*c* and ports 17*a* to permit ports 23 to be aligned with ports 17*a*, to open ports 17*a* to some degree, when the sleeve is driven into engagement with recess 46*c*.

The frac tool may be resistant to fluid flow outwardly therefrom except through open ports 17*a* and fluid cannot pass downwardly past seat 26 in which a ball is seated. Thus, ball 24 is selected to seal in seat 26 and seals 52, such as o-rings, are disposed in glands 54 on the outer surface of the sleeve, so that fluid bypass between the sleeve and wall 42 is substantially prevented and fluid pumped into the tubular body is diverted out through ports 17*a*.

Ball 24 can be formed of ceramics, steel, plastics or other durable materials and is preferably formed to flow back when fluid pressure thereabove, holding it in its seat, is dissipated.

The engagement of collet fingers 27 in recess 46*c*, not only act as a stop for the sleeve but also as a releasable lock for holding the sleeve in the second position. Other releasable locks would be readily apparent. As such, the sleeve is maintained in the second position, even after any fluid pressure-applied force is removed, after the ball falls away from the seat and even if a reverse flow of fluid through ports from the outer surface inwardly to the inner bore causes a suction effect. As such, the first ports remain open during the initial back flow of fracturing fluids including proppant and formation debris. Since ports 17*a* are generally free of inserts, back flow of fluids and debris can occur readily in a generally uncontrolled manner which mitigates the residence of fracturing fluid on the formation.

When it is desired to begin controlling back flow of fluids, for example when it the back flow is likely to be predominantly produced fluids, the sleeve can be moved to the third position to close ports 17*a* and open the second ports 17*b*. In this position, fluid can move into the tubular body, but will be treated by passage through control devices 19*a*, 19*b*.

To move the sleeve, the lock between collet fingers 27 and recess 46*c* must be released. A lock release mechanism may be employed in this regard. The form of the lock release mechanism may depend on the form of the releasable lock. In one embodiment, the lock release mechanism is a manipulation string that is run in to engage the sleeve, overcome the lock by pulling the parts out of engagement, such that the sleeve can be moved from the second position to the third position. In another embodiment, the lock release mechanism includes a lock removal feature that removes some feature of the lock environment so that the parts can be moved apart.

In the illustrated embodiment, the locking effect between collet fingers 27 and recess 46*c* is released by removing a portion of the collet fingers. In particular, lock release is achieved when running the drilling tool to remove the ball seats and clean out the ID of the tubular. For example, when treating a well and leaving the string in the well to achieve production therethrough, it is common to run in with a drilling tool to remove the constrictions in the well caused by ball seats such as seat 26. In this process, the seat portion at Dseat is drilled out back to the drift diameter Dd of the string. In this embodiment, the collet fingers are formed such that they have a portion 27*a* and therebehind a backside gap 33 protruding to define a diameter less than Dd. As such, when a drilling tool is passed through to open up the string to Dd, portion 27*a* is removed and the collect fingers 27 engaged in recess 46*c* are separated from the main body portion of sleeve 22. As such, sleeve 22 is free to move. Collet fingers 27 may remain in recess 46*c* or fall away but will no longer affect the movement of sleeve.

Sleeve 22 can be moved from the second position to the third position in various ways. The sleeve can be moved by engagement and manipulation thereof by a string, such as when the drilling tool is pulled up through the sleeve. It may have engagement dogs that engage against sleeve and pull the sleeve up until it is stopped against shoulder 46*a*. In the illustrated embodiment, a return member is provided to automatically move sleeve upwardly to register ports 23 with ports 17*b*, when the lock is released. In this illustrated embodiment, a biasing member 25 operates as the return member. The biasing member is normally energized and positioned in gap 33 between the main portion of sleeve and collet fingers 27. Biasing member 25 normally exerts a separating force between the main portion of the sleeve and collet fingers 27, but while portion 27*a* remains intact, as in FIGS. 1*a* and 1*b*, the biasing member cannot release the energy stored therein. However, when portion 27*a* is removed, the biasing member can drive the sleeve away from fingers 27 and therefore move the sleeve to the third position. In the illustrated embodiment, biasing member 25 is in the form of a compression spring. However, it is to be understood that biasing member 25 can take other forms, such as a pressure chamber, an elastomeric member, etc.

Since, in this embodiment, the sleeve is stopped by abutment against shoulder 46*a*. The length of the sleeve between its end and ports 23 is selected with consideration as to the distance between shoulder 46*a* and ports 17*b* to permit ports 23 to be aligned with ports 17*b*, to open ports 17*a* to some degree, when the sleeve is driven into engagement with shoulder 46*a*.

It may be desirable to maintain sleeve 22 in the third position for long periods of time. As such, if the positioning of the sleeve in the third position is likely to be driven to move, a second releasable lock in this position may also be of interest. In the illustrated embodiment, a releasable lock may not be required as the biasing member will hold the sleeve in the third position. However, as a back up to ensure position three is maintained even if the biasing member fails or becomes dislodged, a releasable lock may be employed, such as a snap ring 35 sized and positioned to expand out into a no-go recess in groove 46.

Fluids passing in through ports 17*b* are being treated by the control devices 19*a*, 19*b* positioned therein. Since, the control devices are only exposed to substantial flow therethrough after sleeve 22 is moved to the third position, they tend not to be fouled by significantly debris laden fluids such as fracturing fluid back flow.

If sub 40 is used in series with other subs, any subs in the tubing string below sub 40 have seats selected to accept balls having diameters less than Dseat and any subs in the tubing string above sub 40 have seats with diameters greater than the ball diameter Dball useful with seat 26 of sub 40.

Figure 2A:
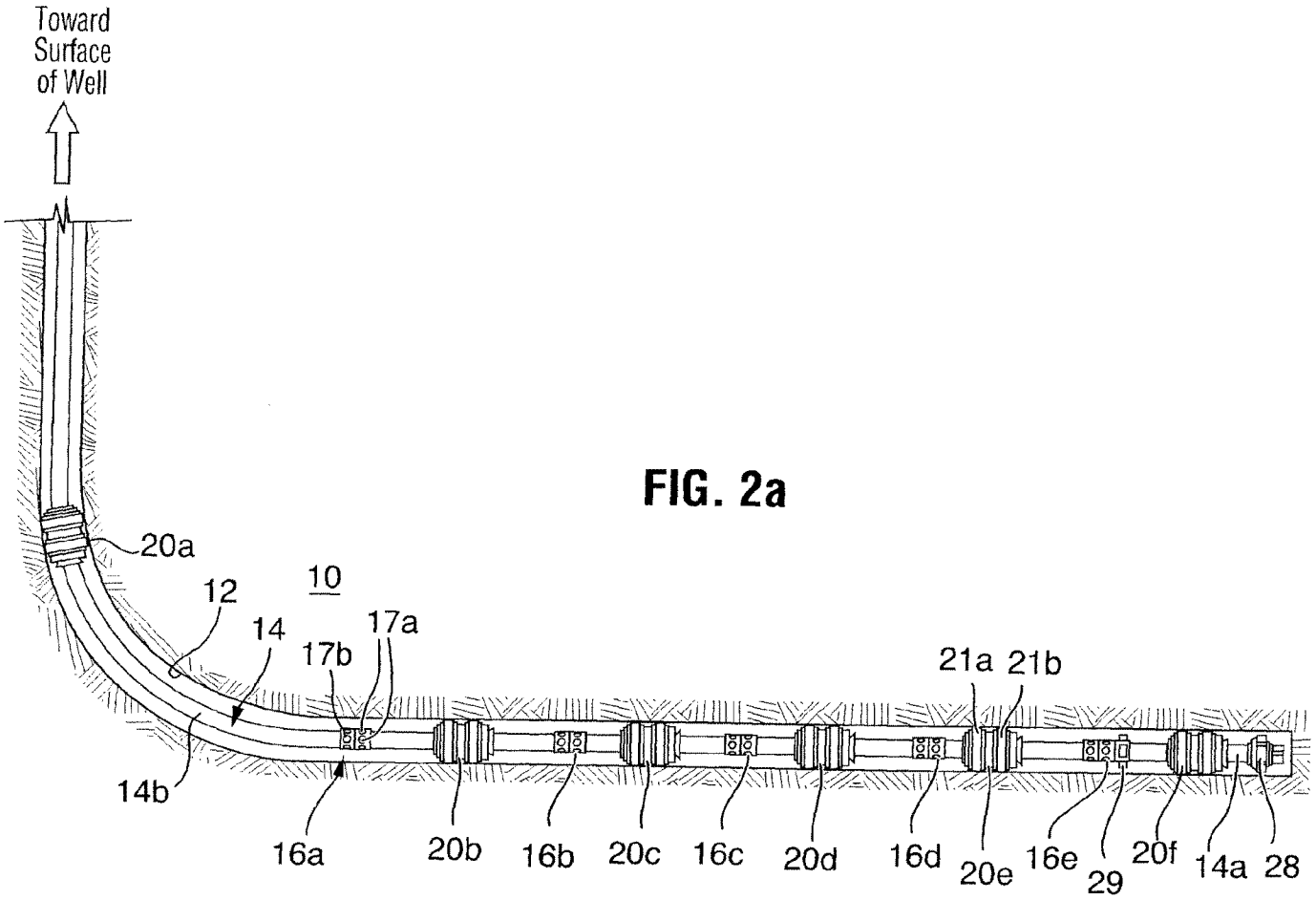
FIG. 2*a* is a sectional view through a wellbore having positioned therein a fluid treatment assembly according to the present invention.
Figure 2B:
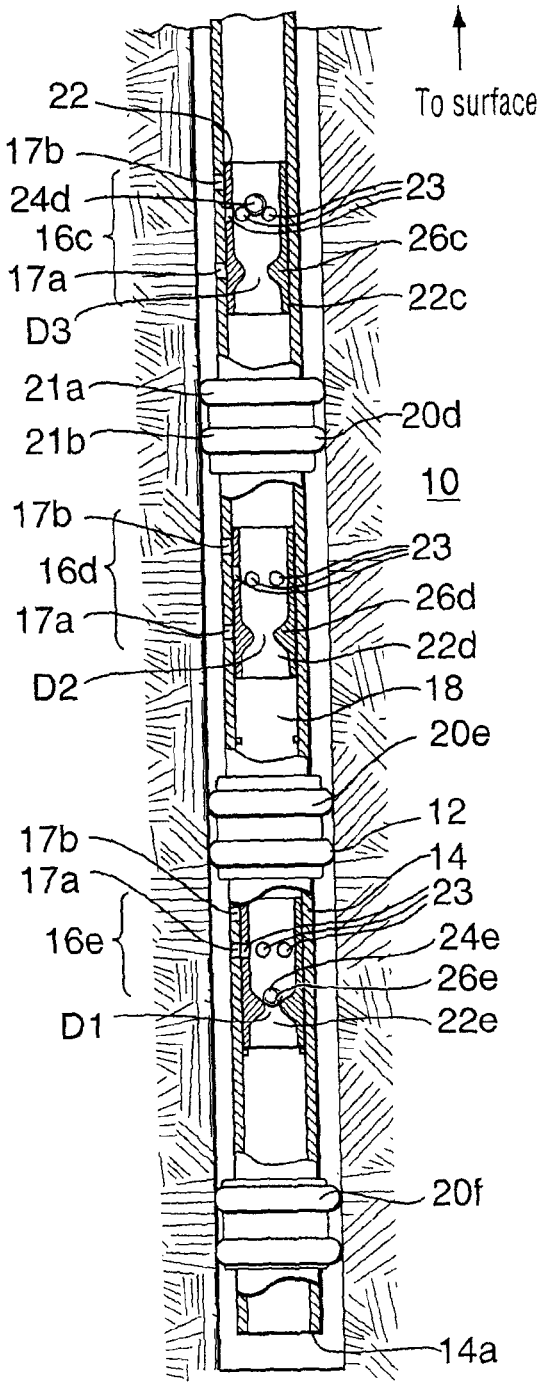
FIG. 2*b* is an enlarged view of a portion of the wellbore of FIG. 2*a* with the fluid treatment assembly also shown in section.

Referring to FIGS. 2*a* and 2*b*, a wellbore fluid treatment assembly is shown, which can be used to effect fluid treatment of a formation 10 through a wellbore 12 and can be left in place to accept inflow, eventually from produced fluids in a controlled way. The wellbore assembly includes a tubing string 14 having a lower end 14*a* and an upper end extending to surface (not shown). Tubing string 14 includes a plurality of spaced apart ported intervals 16*a* to 16*e* each including at least one port and some including a plurality of ports 17*a*, 17*b* opened through the tubing string wall to permit access between the tubing string inner bore 18 and the wellbore.

A packer 20*a*, such as a liner hanger packer, is mounted between the upper-most ported interval 16*a* and the surface and further packers 20*b* to 20*e* are mounted between adjacent ported intervals. In the illustrated embodiment, a packer 20*f* is also mounted below the lower most ported interval 16*e* and lower end 14*a* of the tubing string. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications. In the illustrated embodiment, the packers are disposed about the tubing string and selected to seal the annulus between the tubing string and the wellbore wall, when the assembly is disposed in the wellbore.

The packers may be of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers is positioned with packers in side by side relation on the tubing string, rather than using one packer between each ported interval.

Sliding sleeves 22*c* to 22*e* are disposed in the tubing string to control the opening of the ports. In this embodiment, a sliding sleeve is mounted over each ported interval to close them against fluid flow there through, but can be moved away from their positions covering the ports to open the ports and allow fluid flow therethrough. In particular, the sliding sleeves are disposed to control the opening of the ported intervals through the tubing string by alignment or misalignment of holes 23 with ports 17*a* and 17*b*. The sliding sleeves that protected two axially offset sets of ports are each moveable from a first position covering both sets 17*a*, 17*b* of its associated ported interval (as shown in FIG. 2*b* by sleeves 22*c* and 22*d*) to a second position away from the first set of ports 17*a* wherein fluid flow of, for example, stimulation fluid and back flowing fluids, is permitted through the opened ports of the ported interval (as shown in FIG. 2*b* by sleeve 22*e*) and, thereafter, the sleeves are moveable from the second position, exposing ports 17*a* and covering ports 17*b* of its associated ported interval, to a third position closing ports 17*a* and exposing ports 17*b* for fluid flow therethrough, wherein fluid flow of, for example, produced fluids is permitted through the opened ports 17*b* of the ported interval including any flow control devices therein, as shown by all ports in FIG. 2*c*.

The assembly is run in and positioned downhole with the sliding sleeves each in their first (all ports closed) position. The sleeves are moved to their second position, with ports 17*a* open, when the tubing string is ready for use in fluid treatment of the wellbore. In one embodiment, only certain sleeves are opened at one time to permit fluid flow to the wellbore segments accessed by those certain sleeves, in a staged, concentrated treatment process.

The sliding sleeves may each moveable remotely from their closed port position to their second position, for example, without having to run in a line or string for manipulation thereof. In one embodiment, the sliding sleeves are each actuated by a device, such as plug which may be in the form of a ball 24*e*, which can be conveyed by gravity or fluid flow through the tubing string. The device engages against the sleeve, in this case ball 24*e* engages against sleeve 22*e*, and, when pressure is applied through the tubing string inner bore 18 from surface, ball 24*e* seats against and creates a pressure differential above and below the sleeve which drives the sleeve toward the lower pressure side.

In the illustrated embodiment, the inner surface of each sleeve which is open to the inner bore of the tubing string defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide to second position, opening ports 17*a*. When the first ports of the ported interval 16*e* are opened, fluid can flow therethrough to the annulus between the tubing string and the wellbore and thereafter into contact with formation 10.

Each of the plurality of sliding sleeves has a different diameter seat and therefore each accept different sized balls. In particular, the lower-most sliding sleeve 22*e* has the smallest diameter D1 seat and accepts the smallest sized ball 24*e* and each sleeve that is progressively closer to surface has a larger seat. For example, as shown in FIG. 2*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to move to the second position first by first launching the smallest ball 24*e*, which can pass though all of the seats of the sleeves closer to surface but which will land in and seal against seat 26*e* of sleeve 22*e*. Likewise, penultimate sleeve 22*d* can be actuated to expose ports 17*a* of ported interval 16*d* by launching a ball 24*d* which is sized to pass through all of the seats closer to surface, including seat 26*c*, but which will land in and seal against seat 26*d*.

As will be appreciated, to achieve pressure differential forces as described above with respect to sleeves 22, a port must be opened below each seat. As such, lower end 14*a* of the tubing string can be open, closed and openable or fitted with an openable port, depending on the operational characteristics of the tubing string which are desired. In the illustrated embodiment, includes a pump out plug assembly 28. Pump out plug assembly acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. As will be appreciated, an opening adjacent end 14*a* is only needed where pressure, as opposed to gravity, is needed to convey the first ball to land in the lower-most sleeve. Alternately, the lower most sleeve can be hydraulically actuated, including a fluid actuated piston secured by shear pins, so that the sleeve can be opened remotely without the need to land a ball or plug therein. Any port opened in end, may be left fully open, closable to reverse flow or fitted for controlled inflow.

Figure 2C:
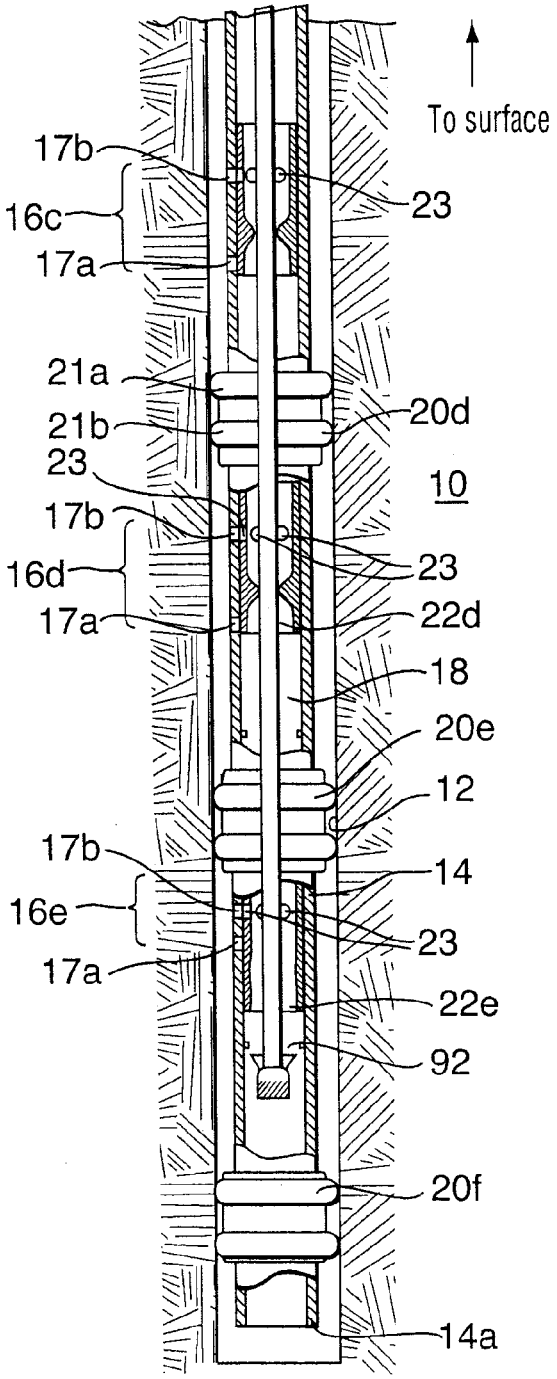
FIG. 2*c* is a view corresponding to FIG. 2*b* with the fluid treatment assembly in the next stage of operation.

The sleeves that have associated therewith two sets of ports can also be moved into the third position, as shown in FIG. 2*c*, wherein ports 17*a* are closed and ports 17*b* are open. The sliding sleeves may each moveable when desired from their second position to their third position. For example, after the force applied to open the sleeves is discontinued, a suitable time for back flow of fracturing fluids may be provided and after that the sleeves may be moved to their third position. In one embodiment, the sliding sleeves are each held in their second position by a releasable lock and a lock release mechanism is employed to release the lock holding the sleeve in place and the sleeve is moved to the third position. In the illustrated embodiment, a drilling tool 90 operates to both remove the seats 24 from the sleeves and to release the lock holding the sleeves in the second position. Each sleeve further includes a biasing member that drives the sleeve automatically to the third position, when the lock is overcome. The drilling tool can further include a latch 92 configured to engage the sleeves when passing upwardly therethrough, the latch acting as a back up to the biasing member and ensuring that the sleeves are indeed moved to the third position, when the drilling tool is pulled back toward surface.

When the second ports 17*b* of the ported interval 16*e* are opened and ports 17*a* are closed, fluid can flow into the tubing string from the annulus outside the tubing string, such fluids likely being predominantly produced fluids from formation 10. The fluids flowing through ports 17*b* are treated by inserts therein, such as to control the particulate load, flow rate and pressure drop of the fluids passing therethrough.

While the illustrated tubing string includes five ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 29 and other standard tubing string attachments can be used.

In use, the wellbore fluid treatment apparatus, as described with respect to FIGS. 2*a*, 2*b* and 2*c*, can be used in the fluid treatment of a wellbore and can remain in place for controlled inflow therethrough. For selectively treating formation 10 through wellbore 12, the above-described assembly is run into the borehole and the packers are set to seal the annulus at each location creating a plurality of isolated annulus zones. Fluids can then be pumped down the tubing string and into a selected zone of the annulus, such as by increasing the pressure to pump out plug assembly 28. Alternately, a plurality of open ports or an open end can be provided or lower most sleeve can be hydraulically openable. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and opens ports 17*a* of ported interval 16*e* to allow the next annulus zone, the zone between packer 20*e* and 20*f* to be treated with fluid. The treating fluids will be diverted through ports 17*a* of interval 16*e* exposed by moving the sliding sleeve and be directed to a specific area of the formation. Ball 24*e* is sized to pass though all of the seats, including 26*c*, 26*d* closer to surface without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens ports 17*a* of ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids.

After treatment, the tubing string can be left in place to act as the production tubing. A problem in wellbore production, is that fluids that are stimulated to be produced may not have entirely desirable flow or content characteristics. If the produced fluids flow through fully open ports, such as ports 17*a*, the produced fluids flow in an uncontrolled manner therethrough. As such, the tubing string, as illustrated, provides inflow control ports 17*b* that can be opened, while ports 17*a* are closed. The closing of ports 17*a* and opening of ports 17*b* can be done in an intentional way, such that they remain open for a selected period after stimulation treatment, but the switch can be made to ports 17*b* when it is appropriate to do so, such as when the return flow is predominately produced fluids rather than back flow of stimulating fluids. However, the invention may provide that the switch is conducted while other necessary wellbore or string processes are being conducted.

As such, the illustrated tubing string can be reconfigured at any time that it is desired to do so, to switch the inward flow of returning fluids from open ports to ports having fluid control features installed therein. Such inflow controlled ports 17*b* may, for example, have screens installed in association therewith (i.e. over or in) to filter out oversize particulate matter.

Alternately or in addition, the inflow controlled ports 17*b* may have ICDs installed in association therewith. For example, a problem in wellbore production, typically along horizontal wells, is that the flow rate of fluids produced from the horizontal section is not uniform over the length between toe 14*a* and heel 14*f*. Instead, the fluid inflow rate is generally higher near the heel compared to the toe due to the inherent pressure drop in the horizontal section. The differential production rate, in some instances, could undesirably limit the overall production that can be achieved for a well. As such, inflow control devices may be employed in inflow ports 17*b* along the horizontal section of the well production tubing between the heel and the toe. The ICDs control the inflow rate into the production tubing along its length and can be set such that an essentially constant inflow rate profile can be achieved from the heel to the toe along the length of the well. In particular, the ICDs can be set to have progressively higher hydraulic flow resistances from the toe to the heel of the horizontal section of the well. For example, the ICDs in the inflow control ports of interval 16*e* can be set to exhibit less resistance to fluid flow therethrough than those of interval 16*d* and the ICDs in the inflow control ports of interval 16*d* can be set to exhibit less resistance to fluid flow therethrough than those of interval 16*c* and so forth. It is to be understood that not all inflow ports need have inflow control. For example, where pressure profile is of concern, some regions of lower production may have inflow ports without any inflow control devices associated therewith.

The ICDs can be overlaid with screen such that oversize debris is prevented from fouling the ICD channels, which may be of relatively small diameter.

Figure 3A:
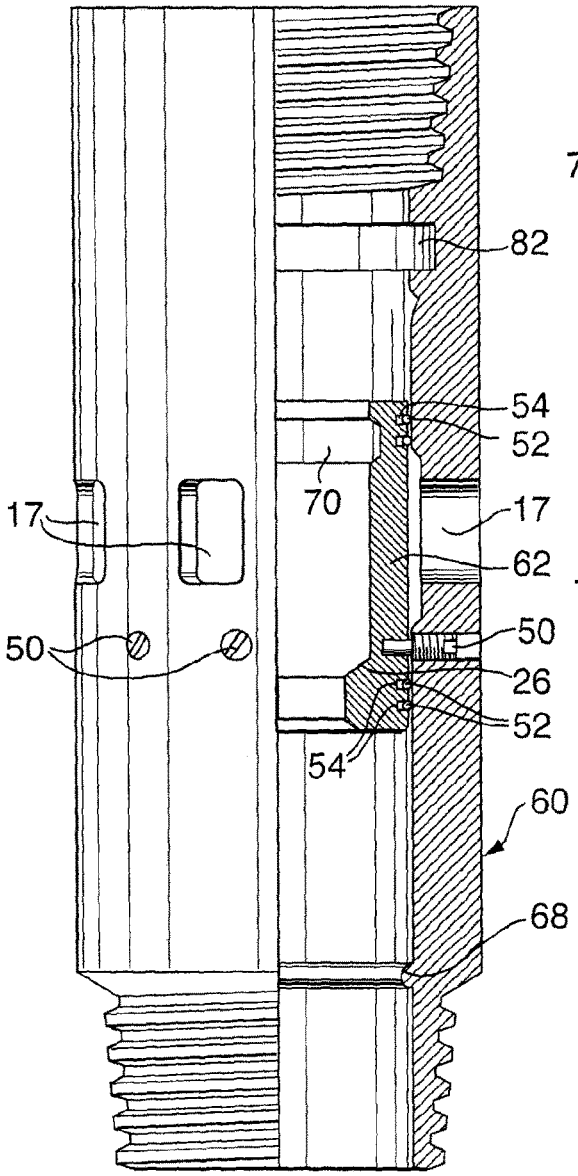
FIG. 3*a* is a quarter sectional view along the long axis of a tubing string sub useful in the present invention containing a sleeve and fluid treatment ports.
Figure 3B:
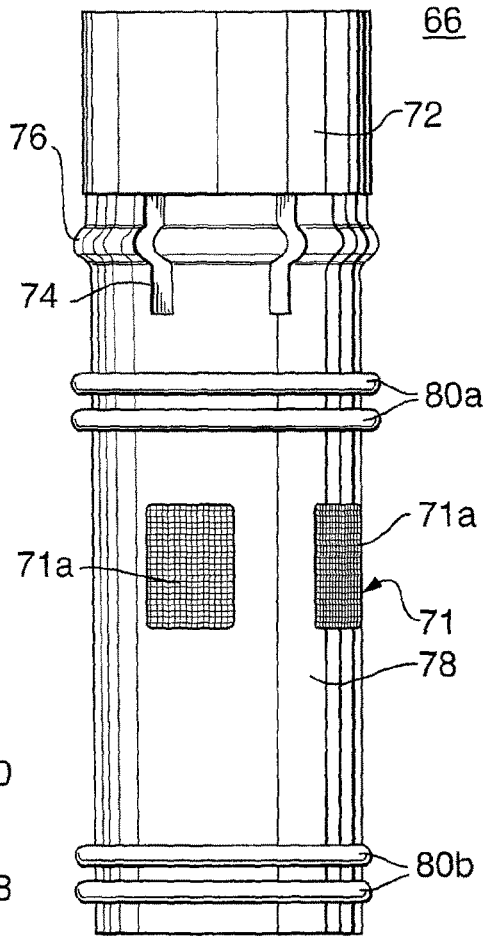
FIG. 3*b* is a side elevation of a flow control sleeve positionable in the sub of FIG. 3*a*.

In one embodiment, as shown in FIG. 3*a*, a sub 60 is used with a retrievable sliding sleeve 62 such that when stimulation and flow back are completed, the ball activated sliding sleeve can be removed from the sub. This facilitates use of the tubing string containing sub 60 for production. This leaves the ports 17 of the sub open or, alternately, a flow control device 66, such as that shown in FIG. 3*b*, can be installed in sub 60.

In sub 60, sliding sleeve 62 is secured by means of shear pins 50 to cover ports 17. When sheared out, sleeve 62 can move within sub until it engages against no-go shoulder 68. Sleeve 62 includes a seat 26, glands 54 for seals 52 and a recess 70 for engagement by a retrieval tool (not shown). Since there is no upper shoulder on the sub, the sleeve can be removed by pulling it upwardly, as by use of a retrieval tool on wireline. This opens the tubing string inner bore to facilitate access through the tubing string such as by tools or production fluids. Where a series of these subs are used in a tubing string, the diameter across shoulders 68 should be graduated to permit passage of sleeves upwardly from therebelow.

Flow control device 66 can be installed in any way in the sub. The flow control device acts to control inflow from the segments in the well through ports 17. In the illustrated embodiment, flow control device 66 includes a running neck 72, a lock section 74 including outwardly biased collet fingers 76 or dogs and a flow control section including a wall section 78 including a plurality of flow control openings 71 having at least one flow control insert 71*a* therein (herein shown as screen) and seals 80*a*, 80*b* disposed at either end thereof. Openings 71 are sized and positioned to overlap with ports 17 of the sub 60 with seals 80*a*, 80*b* disposed above and below, respectively, the ports. Flow control device 66 can be conveyed by wire line or a tubing string such as coil tubing and is installed by engagement of collet fingers 76 in a groove 82 formed in the sub.

Referring to the FIGS. 4*a* to 4*d*, a hydraulically actuable frac tool sleeve valve 110 is shown for use downhole. Sleeve valve 110 may include a tubular segment 112, a sleeve 114 supported by the tubular segment and a driver, shown generally at reference number 116, to drive the sleeve to move.

Sleeve valve 110 may be intended for use in wellbore tool applications. For example, the sleeve valve may be employed in wellbore treatment applications and in which the valve is intended to remain in the hole, after the wellbore treatment, for accepting production fluids. Tubular segment 112 may be a wellbore tubular such as of pipe, liner casing, etc. and may be a portion of a tubing string. Tubular segment 112 may include a bore 112*a* in communication with the inner bore of a tubing string such that pressures may be controlled therein and fluids may be communicated from surface therethrough, such as for wellbore treatment. Tubular segment 112 may be formed in various ways to be incorporated in a tubular string. For example, the tubular segment may be formed integral or connected by various means, such as threading, welding etc., with another portion of the tubular string. For example, ends 112*b*, 112*c* of the tubular segment, shown here as blanks, may be formed for engagement in sequence with adjacent tubulars in a string. For example, ends 112*b*, 112*c* may be formed as threaded pins or boxes to allow threaded engagement with adjacent tubulars.

Figure 4A:
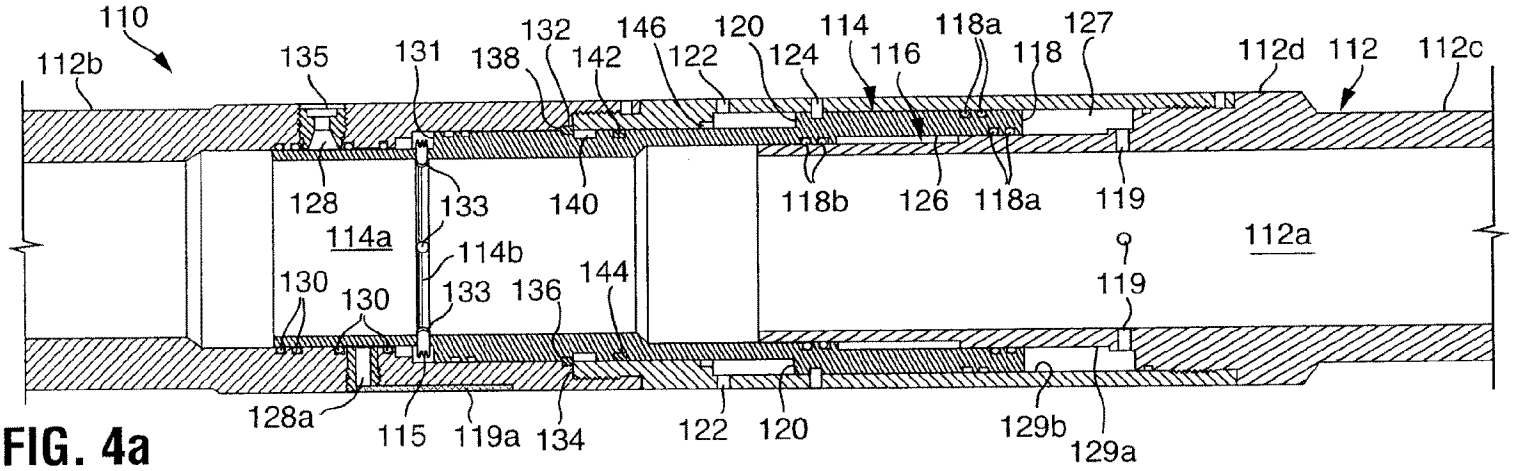
FIGS. 4*a*, 4*b*, 4*c* and 4*d* are axial sectional views of a sleeve valve in run in, intermediate, fluid treatment intermediate and inflow controlled positions, respectively, according to one aspect of the present invention.
Figure 4B:
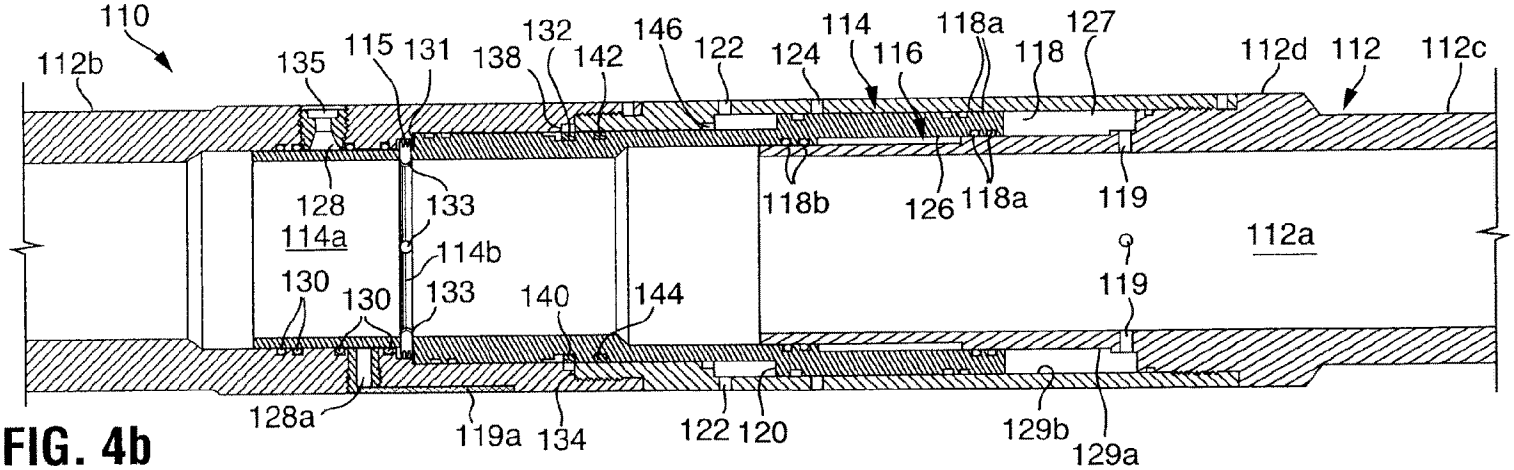
Figure 4C:
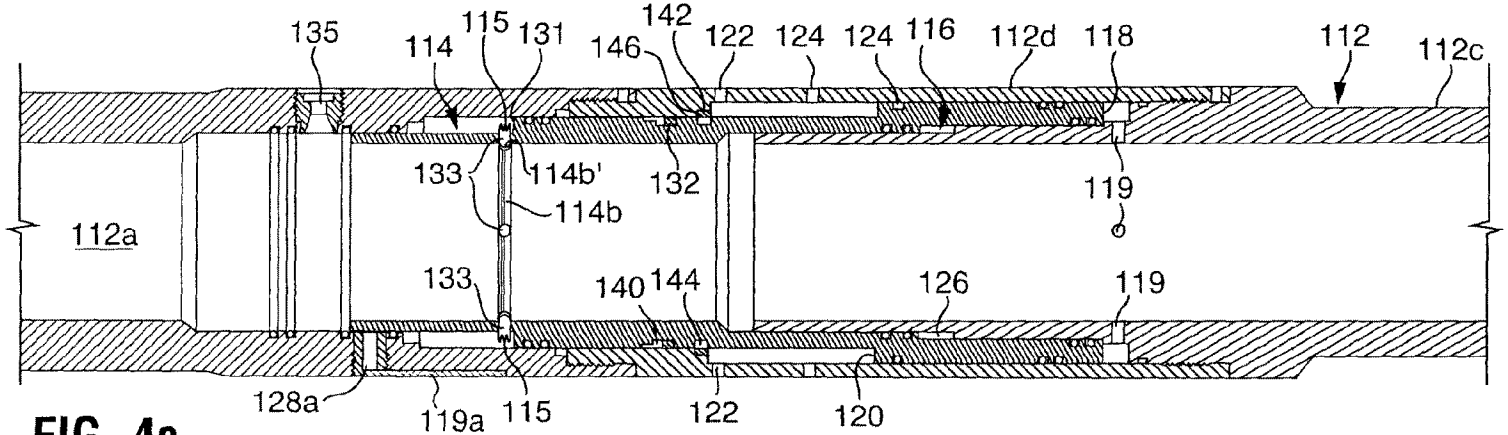
Figure 4D:
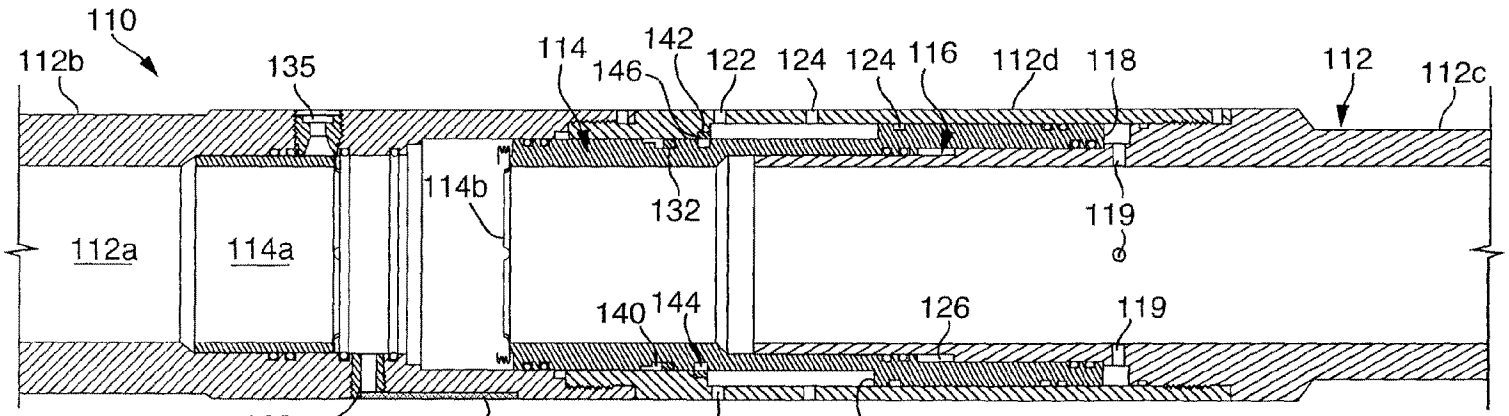

Sleeve 114 may be installed to act as a piston in the tubular segment, in other words to be axially moveable relative to the tubular segment at least some movement of which is driven by fluid pressure. Sleeve 114 may be axially moveable through a plurality of positions. For example, as presently illustrated, sleeve 114 may be moveable through a run in position (FIG. 4*a*), an intermediate position (FIG. 4*b*), a wellbore treatment position (FIG. 4*c*) and an inflow-controlled position (FIG. 4*d*). The installation site for the sleeve in the tubular segment is formed to allow for such movement.

Sleeve 114 may include a first piston face 118 in communication, for example through ports 119, with the inner bore 112*a* of the tubular segment such that first piston face 118 is open to tubing pressure. Sleeve 114 may further include a second piston face 120 in communication with the outer surface 112*d* of the tubular segment. For example, one or more ports 122 may be formed from outer surface 112*d* of the tubular segment such that second piston face 120 is open to annulus, hydrostatic pressure about the tubular segment. First piston face 118 and second piston face 120 are positioned to act oppositely on the sleeve. Since the first piston face is open to tubing pressure and the second piston face is open to annulus pressure, a pressure differential can be set up between the first piston face and the second piston face to move the sleeve by offsetting or adjusting one or the other of the tubing pressure or annulus pressure. In particular, although hydrostatic pressure may generally be equalized between the tubing inner bore and the annulus, by increasing tubing pressure, as by increasing pressure in bore 112*a* from surface, pressure acting against first piston face 118 may be greater than the pressure acting against second piston face 120, which may cause sleeve 114 to move toward the low pressure side, which is the side open to face 120, into a selected intermediate position (FIG. 4*b*). Seals 118*a*, such as o-rings, may be provided to act against leakage of fluid from the bore to the annulus about the tubular segment such that fluid from inner bore 112*a* is communicated only to face 118 and not to face 120.

One or more releasable setting devices 124 may be provided to releasably hold the sleeve in the run-in position. Releasable setting devices 124, such as one or more of a shear pin (a plurality of shear pins are shown), a collet, a c-ring, etc. provide that the sleeve may be held in place against inadvertent movement out of any selected position, but may be released to move only when it is desirable to do so. In the illustrated embodiment, releasable setting devices 124 may be installed to maintain the sleeve in its run-in position but can be released, as shown sheared in FIGS. 4*a* and 4*c*, by differential pressure between faces 118 and 120 to allow movement of the sleeve. Selection of a releasable setting device, such as shear pins to be overcome by a pressure differential is well understood in the art. In the present embodiment, the differential pressure required to shear out the sleeve is affected by the hydrostatic pressure and the rating and number of shear pins.

Driver 116 may be provided to move the sleeve into the wellbore treatment position. The driver may be selected to be unable to move the sleeve until releasable setting device 124 is released. Since driver 116 is unable to overcome the holding power of releasable setting devices 124, the driver can only move the sleeve once the releasable setting devices are released. Since driver 116 cannot overcome the holding pressure of releasable setting devices 124 but the differential pressure can overcome the holding force of devices 124, it will be appreciated then that driver 116 may apply a driving force less than the force exerted by the differential pressure such that driver 116 may also be unable to overcome or act against a differential pressure sufficient to overcome devices 124. Driver 116 may take various forms. For example, in one embodiment, driver 116 may include a spring and/or a gas pressure chamber 126, as shown, to apply a push or pull force to the sleeve or to simply allow the sleeve to move in response to an applied force such as an inherent or applied pressure differential or gravity. In the illustrated embodiment of FIG. 4, driver 116 employs hydrostatic pressure through piston face 120 that acts against trapped gas chamber 126 defined between tubular segment 112 and sleeve 114. Chamber 126 is sealed by seals 118*a*, 118*b*, such as o-rings, such that any gas therein is trapped. Chamber 126 includes gas trapped at atmospheric or some other low pressure. Generally, chamber 126 includes air at surface atmospheric pressure, as may be present simply by assembly of the parts at surface. In any event, generally the pressure in chamber 126 is somewhat less than the hydrostatic pressure downhole. As such, when sleeve 114 is free to move, a pressure imbalance occurs across the sleeve at piston face 120 causing the sleeve to move toward the low pressure side, as provided by chamber 126, if no greater forces are acting against such movement.

In the illustrated embodiment, sleeve 114 moves axially in a first direction when moving from the run-in position to the intermediate position and reverses to move axially in a direction opposite to the first direction when it moves from the intermediate position to the wellbore treatment position. In the illustrated embodiment, sleeve 114 passes through the run-in position on its way to the wellbore treatment position. The illustrated sleeve configuration and sequence of movement allows the sleeve to continue to hold pressure in the run-in position and the intermediate position. When driven by tubing pressure to move from the run-in position into the intermediate position, the sleeve moves from one overlapping, sealing position over port 128 into a further overlapping, port closed position and not towards opening of the port. As such, as long as tubing pressure is held or increased, the sleeve will remain in a port closed position and the tubing string in which the valve is positioned will be capable of holding pressure. The intermediate position may be considered a closed but activated or passive position, wherein the sleeve has been acted upon, but the valve remains closed. In the presently illustrated embodiment, the pressure differential between faces 118 and 120 caused by pressuring up in bore 112*c* does not move the sleeve into or even toward a port open position. Pressuring up the tubing string only releases the sleeve for later opening. Only when tubing pressure is dissipated to reduce or remove the pressure differential, can sleeve 114 move into the third, port open position.

While the above-described sleeve movement may provide certain benefits, of course other directions, traveling distances and sequences of movement may be employed depending on the configuration of the sleeve, piston chambers, releasable setting devices, driver, etc. In the illustrated embodiment, the first direction, when moving from the run-in position to the intermediate position, may be towards surface and the reverse direction may be downhole.

Sleeve 114 may be installed in various ways on or in the tubular segment and may take various forms, while being axially moveable along a length of the tubular segment. For example, as illustrated, sleeve 114 may be installed in an annular opening 127 defined between an inner wall 129*a* and an outer wall 129*b* of the tubular segment. In the illustrated embodiment, piston face 118 is positioned at an end of the sleeve in annular opening 127, with pressure communication through ports 119 passing through inner wall 129*a*. Also in this illustrated embodiment, chamber 126 is defined between sleeve 114 and inner wall 129*a*. Also shown in this embodiment but again variable as desired, an opposite end of sleeve 114 extends out from annular opening 127 to have a surface in direct communication with inner bore 112*a*. Sleeve 114 may include one or more stepped portions 131 to adjust its inner diameter and thickness. Stepped portions 131, if desired, may alternately be selected to provide for piston face sizing and force selection. In the illustrated embodiment, for example, stepped portion 131 provides another piston face on the sleeve in communication with inner bore 112*a*, and therefore tubing pressure, through ports 133. The piston face of portion 131 acts with face 120 to counteract forces generated at piston face 118. In the illustrated embodiment, ports 133 also act to avoid a pressure lock condition at stepped portion 131. The face area provided by stepped portion 131 may be considered when calculating the total piston face area of the sleeve and the overall pressure effect thereon. For example, faces 118, 120 and 131 must all be considered with respect to pressure differentials acting across the sleeve and the effect of applied or inherent pressure conditions, such as applied tubing pressure, hydrostatic pressure acting as driver 116. Faces 118, 120 and 131 may all be considered to obtain a sleeve across which pressure differentials can be readily achieved.

In operation, sleeve 114 may be axially moved relative to tubular segment 112 between the three positions. For example, as shown in FIG. 4*a*, the sleeve valve may initially be in the run-in position with releasable setting devices 124 holding the sleeve in that position. To move the sleeve to the intermediate position shown in FIG. 4*b*, pressure may be increased in bore 112*a*, which pressure is not communicated to the annulus, such that a pressure differential is created between face 118 and face 120 across the sleeve. This tends to force the sleeve toward the low pressure side, which is the side at face 120. Such force releases devices 124, for example shears the shear pins, such that sleeve 114 can move toward the end defining face 120 until it arrives at the intermediate position (FIG. 4*b*). Thereafter, pressure in bore 112*a* can be allowed to relax such that the pressure differential is reduced or eliminated between faces 118 and 120. At this point, since the sleeve is free from the holding force of devices 124, once the pressure differential is sufficiently reduced, the force in driver 116 may be sufficient to move the sleeve into the wellbore treatment position (FIG. 4*c*). In the illustrated embodiment, for example, the hydrostatic pressure may act on face 120 and, relative to low pressure chamber 126, a pressure imbalance is established that may tend to drive sleeve 114 to the illustrated embodiment of FIG. 4*c*, which is the wellbore treatment position.

As such, a pressure increase within the tubular segment causes a pressure differential that releases the sleeve and renders the sleeve into a condition such that it can be acted upon by a driving force to move the sleeve to a further position. Pressuring up is only required to release the sleeve and not to move the sleeve into a port open position. In fact, since any pressure differential where the tubing pressure is greater than the annular pressure holds the sleeve in a port-closed, pressure holding position, the sleeve can only be acted upon by the driving force once the tubing pressure generated differential is dissipated. The sleeve may, therefore, be actuated by pressure cycling wherein a pressure increase within the tubular segment causes a pressure differential that releases the sleeve and renders the sleeve in a condition such that it can be acted upon by a driver, such as existing hydrostatic pressure, to move the sleeve to a further position.

The sleeve valve of the present invention may be useful in various applications where it is desired to move a sleeve through a plurality of positions, where it is desired to actuate a sleeve to open after increasing tubing pressure, where it is desired to open a port in a tubing string hydraulically but where the fluid pressure must be held in the tubing string for other purposes prior to opening the ports to equalize pressure and/or where it is desired to open a plurality of sleeve valves in the tubing string hydraulically at substantially the same time without a risk of certain of the valves failing to open due to pressure equalization through certain others of the valves that opened first. In the illustrated embodiment, for example, sleeve 114 in both the first and intermediate positions is positioned to cover port 128 and seal it against fluid flow therethrough. However, in the wellbore treatment position, sleeve 114 has been pulled back away from port 128 and leaves it open, at least to some degree, for fluid flow therethrough. Although a tubing pressure increase releases the sleeve to move into the intermediate position, the valve can still hold pressure in the intermediate position and, in fact, tubing pressure creating a pressure differential across the sleeve actually holds the sleeve in a port closed position. Only when pressure is released after a pressure up condition, can the sleeve move to the port open position. Seals 130 may be provided to assist with the sealing properties of sleeve 114 relative to port 128. Such port 128 may open to an annular string component, such as a packer to be inflated, or, as shown, may open bore 112*a* to the annular area about the tubular segment, such as may be required for wellbore treatment or production. In one embodiment, for example, the sleeve may be moved to expose and open port 128 through the tubular segment such that fluids from bore 112*a* can be injected into the annulus.

In the illustrated embodiment, for example, one or more ports 128 pass through the wall of tubular segment 112 for passage of fluids between bore 112*a* and outer surface 112*d* and, in particular, the annulus about the string. In the illustrated embodiment ports 128 each include a nozzle insert 135 for jetting fluids radially outwardly therethrough. Nozzle insert 135 may include a convergent type orifice, having a fluid opening that narrows from a wide diameter to a smaller diameter in the direction of the flow, which is outwardly from bore 112*a* to outer surface 112*d* such that the wider diameter is adjacent the inner diameter of the tubular and the smaller diameter is radially outward of the larger diameter, adjacent the outer surface of the tubular. As such, nozzle insert 135 may be useful to generate a fluid jet with a high exit velocity passing through the port in which the insert is positioned. Alternately or in addition, ports 128 may have installed therein a choking device for regulating the rate or volume of flow outwardly therethrough, such as may be useful in limited entry systems.

As illustrated, valve 110 may include one or more locks, as desired. For example, a lock may be provided to resist sleeve 114 of the valve from moving from the run-in position directly to the wellbore treatment position and/or a lock may be provided to resist the sleeve from moving from the wellbore treatment position back to the intermediate position. In the illustrated embodiment, for example, an inwardly biased c-ring 132 is installed to act between a shoulder 134 on tubular member 112 and a shoulder 136 on sleeve 114. By acting between the shoulders, they cannot approach each other and, therefore, sleeve 114 cannot move from the run-in position directly toward the wellbore treatment position, even when shear pins 124 are no longer holding the sleeve. C-ring 132 does not resist movement of the sleeve from the run-in position to the intermediate position. However, the c-ring may be held by another shoulder 138 on tubular member 112 against movement with the sleeve, such that when sleeve 114 moves from the run-in position to the intermediate position the sleeve moves past the c-ring. Sleeve 114 includes a gland 140 that is positioned to pass under the c-ring as the sleeve moves and, when this occurs, c-ring 132, being biased inwardly, can drop into the gland. Gland 140 may be sized to accommodate the c-ring no more than flush with the outer diameter of the sleeve such that after dropping into gland 140, c-ring 132 may be carried with the sleeve without catching again on parts beyond the gland. As such, after c-ring 132 drops into the gland, it does not inhibit further movement of the sleeve.

Another lock may be provided, for example, in the illustrated embodiment to resist movement of the sleeve from the wellbore treatment position back to the intermediate position. The lock may also employ a device such as a c-ring 142 with a biasing force to expand from a gland 144 in sleeve 114 to land against a shoulder 146 on tubular member 112, when the sleeve carries the c-ring to a position where it can expand. The gland for c-ring 142 and the shoulder may be positioned such that they align when the sleeve moves substantially into the wellbore treatment position. When c-ring 142 expands, it acts between one side of gland 144 and shoulder 146 to prevent the sleeve from moving from the wellbore treatment position back toward the intermediate position.

The tool may be formed in various ways. As will be appreciated, it is common to form wellbore components in tubular, cylindrical form and oftentimes, of threadedly or weldedly connected subcomponents. For example, tubular segment in the illustrated embodiment is formed of a plurality of parts connected at threaded intervals. The threaded intervals may be selected to hold pressure, to form useful shoulders, etc., as desired.

As noted above, it may be desirable in some applications to provide the sleeve valve with an in-flow controlled position. For example, in some applications it may be useful to open port 128 to permit fluid flow therethrough and then later close the port 128 and open other port 128*a* that has an inflow control device associated therewith such as a screen or an ICD 119*a*. As such at least a portion 114*a* of the sleeve may be moveable from the wellbore treatment position to a position blocking flow through port 128 but opening flow through ports 128*a*. For example, in one embodiment, a portion 114*a* of the sleeve is separable from the sleeve and is positionable to block fluid flow through port 128 but exposes port 128*a* to the tubular inner bore such that fluid can flow therethrough. In the illustrated embodiment, for example, the sleeve includes a connecting web 114*b* that connects portion 114*a* to the remainder of the sleeve. Web 114*b* is formed to extend radially inwardly of the inner diameter ID of the sleeve and is thinned such that the backside 114*b*' thereof also protrudes inwardly of ID. As such, at least an upper surface of web 114*b* can be removed by a drilling tool passed through the ID of the sub, as is common after fluid treatment. After web 114*b* is removed, portion 114*a* can be separated from the remainder of the sleeve and can be moved to a position blocking flow through port 128 but opening flow through port 128*a*. A biasing member 115, such as for example a pressurized gas chamber, such as a nitrogen chamber charge, may be positioned to drive movement of portion 114*a* once it is separated from the remainder of the sleeve. Biasing member 115 may be installed in a energized condition, for example acting between the sides of ports 133. The biasing member may move with the sleeve during run in, etc. but cannot release the energy therein until the web is removed and the portion 114*a* is able to separate from the remainder of the sleeve. When the web is removed, the remainder of the sleeve is locked by ring 143 and the energy in the biasing member may drive portion 114*a* back along the bore 112*a* until stopped by a stop wall 112*d*. Stop wall 112*d* is spaced from ports 128 and 128*a* with consideration as to the length of portion 114*a* such that when the sleeve portion 114*a* is stopped against the wall 112*d*, it is clear of port 128*a* but covers port 128. A lock may be employed between sleeve portion 114*a* and the tubular in order to hold the sleeve portion in place.

In the illustrated embodiment, ICD is shown as a labyrinth channel system, but other ICD mechanisms may be employed. In one embodiment, the ICD is adjustable and in one embodiment remotely adjustable, such as while positioned downhole.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. An apparatus for fluid treatment of a wellbore, the apparatus comprising:

a tubular body with a wall having a first port opened through the wall of the tubular body, and a second port opened through the wall of the tubular body, a fluid inflow controller positioned in the second port to control the flow of fluid into the tubular body through the second port, a sliding sleeve valve in the tubular body with one or more ports, the sliding sleeve valve being moveable from (i) a first position closing the first port and the second port to (ii) a second position closing the second port and permitting fluid flow through the first port and to (iii) a third position closing the first port and permitting fluid flow through the second port;

a releasable setting device for holding the sliding sleeve valve in the first position;

a seat on the sliding sleeve valve, for receiving a plug conveyed through the tubular body, to move the sliding sleeve valve from the first position to the second position in response to a force applied to the seat through the plug;

a releasable lock for holding the sliding sleeve valve in the second position, a lock release mechanism configured to enable the sliding sleeve valve to move from the second position into the third position to accept flow back of production fluids into the tubular body; and a biasing member for holding the sliding sleeve valve in the third position.

2. The apparatus of claim 1 where the fluid inflow controller includes a choke for controlling one or more of the pressure drop and flow rate of the fluid passing through the second port.

3. The apparatus of claim 1 where the seat formed on the sliding sleeve valve and the plug are sized to seal the tubular body, such that a pressure can be built up to move the sliding sleeve valve until the one or more ports on the sliding sleeve valve align with the first and second ports.

4. The apparatus of claim 1 wherein the releasable lock includes one or more catches engageable in a lock site.

5. The apparatus of claim 1 wherein the biasing member is adapted to move the sliding sleeve valve into the third position.

6. The apparatus of claim 1, wherein the releasable lock is a collet, which locks the sliding sleeve valve in the second position by engaging a shoulder in the tubular body.

7. The apparatus of claim 1, wherein the fluid inflow controller includes one or more screens for filtering out oversize solids from the fluid.

8. The apparatus of claim 1, wherein the releasable setting device comprises one or more shear pins secured between the wall of the tubular body and the sliding sleeve valve.

9. The apparatus of claim 1 further comprising a second releasable lock to maintain the sliding sleeve valve in the third position, wherein the second releasable lock continues to maintain the sliding sleeve valve in the third position upon any of a failure or dislodgment of the biasing member.

10. A method for fluid treatment of a wellbore, the method comprising:

running a frac tool into the wellbore to a selected zone in the wellbore, the frac tool having a tubular body with one or more frac ports, one or more fluid control ports, a sliding sleeve valve with one or more ports that is positioned in the tubular body so as to close fluid flow through the one or more frac and fluid control ports, and a seat formed on the sliding sleeve valve for receiving a plug conveyed through the tubular body;

conveying the plug to the seat, applying pressure to the plug to move the sliding sleeve valve to allow fluid flow through the one or more frac ports;

releasably locking the sliding sleeve valve;

injecting stimulating fluids through the one or more frac ports into the selected zone for fracturing treatment of the formation;

unlocking the sliding sleeve valve to allow the sliding sleeve valve to disallow fluid flow through the one or more frac ports and to allow fluid flow through the one or more fluid control ports from the wellbore into the tubular body; and controlling flow of production fluids using an inflow control device in the one or more fluid control ports.

11. The method of claim 10 wherein unlocking includes moving a drill past the sliding sleeve valve to overcome a force presented by a lock release mechanism that maintains the sliding sleeve valve.

12. The method of claim 10 wherein after unlocking, the sliding sleeve valve is moved by a biasing member to open the one or more fluid control ports.

13. The method of claim 10, wherein allowing fluid flow through the one or more fluid control ports comprises aligning the one or more ports on the sliding sleeve valve with the one or more fluid control ports.

14. The method of claim 13, wherein aligning the one or more ports on the sliding sleeve valve with the one or more fluid control ports comprises releasing a biasing member.

15. The method of one of claim 12 wherein the biasing member is one of a spring, a pressure chamber, or an elastomeric member.

* * * * *